United States Patent [19]

Satake

[11] Patent Number: 4,913,045

[45] Date of Patent: Apr. 3, 1990

[54] POLISHED-RICE HUMIDIFYING APPARATUS AND RICE MILLING SYSTEM

[75] Inventor: Toshihiko Satake, Higashihiroshima, Japan

[73] Assignee: Satake Engineering Co., Ltd., Tokyo, Japan

[21] Appl. No.: 326,009

[22] Filed: Mar. 20, 1989

[30] Foreign Application Priority Data

Mar. 23, 1988 [JP] Japan ..... 63-70386
Apr. 18, 1988 [JP] Japan ..... 63-96474

[51] Int. Cl.[4] ..... B04B 9/14

[52] U.S. Cl. ..... 99/519; 99/521; 99/606; 99/610; 99/611; 99/613; 99/617

[58] Field of Search ..... 99/516, 518, 519–522, 99/525, 526, 528, 568, 611, 602–606, 612–614, 617; 426/461, 507, 511; 100/117, 145; 366/90, 318, 324; 241/8, 23

[56] References Cited

U.S. PATENT DOCUMENTS 4,133,257 1/1979 Satake ..... 99/613
4,148,251 4/1979 Satake ..... 99/602
4,324,175 4/1982 Satake ..... 99/519
4,344,975 8/1982 Seiler ..... 426/285
4,488,481 12/1984 Satake ..... 99/518

*Primary Examiner*—Timothy F. Simone
*Attorney, Agent, or Firm*—Wegner & Bretschneider

[57] ABSTRACT

In an apparatus for humidifying polished rice, a conveyor has a tubular housing which defines a predetermined transport path for the polished rice. The conveyor conveys the polished rice, while steering the same, along the transport path. A humidifier is arranged in association with the transport path for adding moisture to the polished rice conveyed along the transport path to humidify the polished rice. A blower is arranged in association with the transport path for causing air to flow therealong. A rice milling system comprises a rice polishing machine and the apparatus connected thereto. The rice polishing machine polishes brown rice to form the polished rice. Polishing of the brown rice to the polished rice raises temperature of the polished rice. The polished rice elevated in temperature is supplied to the housing of the apparatus.

19 Claims, 7 Drawing Sheets

POLISHED-RICE HUMIDIFYING APPARATUS AND RICE MILLING SYSTEM

BACKGROUND OF THE INVENTION

The present invention relates to an apparatus for humidifying polished rice and to a rice milling system comprising the apparatus and a rice polishing machine.

During polishing of brown rice by a rice polishing machine to form polished rice, heat is generated to take moisture away from the rice, resulting in deterioration of the taste of cooked rice. Generally, therefore, the polished rice is humidified after having been polished by the rice polishing machine. Specifically, the rice after having been polished is charged into a tank of a humidifying apparatus. Moisture is added to the polished rice by the humidifying apparatus slowly at a rate of the order of 0.2% to 0.3% per hour for a period of time of five (5) to ten (10) hours, in order to prevent abrupt absorption of moisture from causing cracks to be formed in the polished rice. In this manner, the polished rice is finished to one having a moisture content of about 14% to 15% which is adequate for rice to be cooked by boiling. That is to say, it is now essential to humidify the rice after having been polished, because of a recent tendency that a producer delivers brown rice which is dried slightly excessively, and because of a demand for tasty rice from consumers.

The above-described humidifying apparatus is known from Japanese Patent Application Laid-Open No. Sho 60-25548 filed by the same applicant as this application. The humidifying apparatus is arranged between a plurality of rice polishing machines, to form a rice processing line or a rice milling system. The humidifying apparatus comprises an air supply chamber and an air discharge chamber which are arranged respectively on one and other sides of the tank. A plurality of air supply passages communicating with the air supply chamber and a plurality of air discharge passages communicating with the air discharge chamber are arranged within the tank one over another alternately and in a zigzag fashion. The tank is formed at its bottom with a discharge port to which a discharge pipe is connected. A recirculation passage has one end thereof connected to the discharge pipe and the other end connected to the tank. A selector valve is arranged at the connection between the discharge pipe and the one end of the recirculation passage. Polished rice is recirculated through the tank by the recirculation passage while being humidified, so that the polished rice is humidified and is brought to a predetermined moisture content. In this case, a moisture absorption rate does not exceed 0.2% to 0.3% per hour. Accordingly, about five (5) hours are required to raise the moisture content of the polished rice by 1%. This results in lowering of a serviceability ratio of the rice milling system.

In the recent rice milling system, various instruments or equipments having their respective large processing capacities are arranged in series, and efficient operation is carried out by these equipments. Since, however, the step of humidifying the polished rice takes five to ten hours as described above, the humidification step interrupts continuous flow of the entire steps of the system. In addition, the humidification requires the tank of large capacity.

Further, the rate of absorption of moisture of the polished rice differs from part to part of the polished rice grain. Specifically, the back side of the polished rice grain is difficult to absorb moisture, while the front side is easy to absorb moisture. Accordingly, if moisture adheres to the polished rice grain in a one-sided fashion when the polished rice is tempered, cracks are formed in the rice grain because of a difference in rate of moisture absorption.

SUMMARY OF THE INVENTION

It is therefore an object of the invention to provide a polished-rice humidifying apparatus capable of humidifying rice after having been polished, for a period of time as short as possible, to bring a moisture content of the rice to a value of, for example, about 14% to 15%.

For the above purpose, according to the invention, there is provided an apparatus for humidifying polished rice, comprising:

conveyor means having a tubular housing defining a predetermined transport path for the polished rice, for conveying the polished rice, while steering the same, along the transport path;

humidifying means arranged in association with the transport path for adding moisture to the polished rice conveyed along the transport path, by such an amount of moisture as not to form cracks in the polished rice, thereby humidifying the same; and air-flow means arranged in association with the transport path for causing air to flow along the transport path, to remove excess moisture from the polished rice humidified by the humidifying means.

The arrangement of the polished-rice humidifying apparatus according to the invention is such that the humidifying means adds moisture to the polished rice conveyed along the transport path, by such an amount of moisture as not to form cracks in the polished rice, and the flow of air caused by the air-flow means removes excess moisture from the polished rice humidified by the humidifying means. With the arrangement, the moisture can be added to the polished rice for a short period of time without formation of cracks in the polished rice.

It is another object of the invention to provide a rice milling system comprising a rice milling machine and the above-described polished-rice humidifying apparatus, which is capable of humidifying polished rice for a short period of time, whereby the humidification can be prevented from interfering with a continuous processing line.

For the purpose, according to the invention, there is provided a rice milling system comprising:

a rice polishing machine for polishing brown rice to form polished rice, wherein polishing of the brown rice to the polished rice raises temperature of the polished rice; and an apparatus for humidifying the polished rice from the rice milling machine, the apparatus including conveyor means having a tubular housing defining a predetermined transport path for the polished rice, for conveying the polished rice, while steering the same, along the transport path, supply means connected to the rice milling machine and to the tubular housing at a location adjacent one end of the transport path, the polished rice from the rice polishing machine being supplied onto the transport path through the supply means, humidifying means arranged in association with the transport path for adding moisture to the polished rice conveyed along the transport path, by such an amount of moisture as not to form cracks in the polished rice, thereby humidifying the same, air-flow means arranged in association with the transport path for causing air to flow along the transport path, to remove excess moisture from the polished rice humidified by the humidifying means, and discharge means connected to the tubular housing at a location adjacent the other end of the transport path, the humidified polished rice being discharged out of the tubular housing through the discharge means.

The arrangement of the rice milling system according to the invention is such that the polished rice fed to the humidifying apparatus is elevated in temperature under the polishing action due to the rice polishing machine. For the polished rice elevated in temperature, moisture tends to move or diverge from an inner layer of each rice grain toward an outer layer thereof. Under such condition, even if moisture is added to rice grains by, for example, 1% by weight at a humidifying rate of the order of five times a safe humidifying rate with respect to polished rice lowered in temperature substantially to the surrounding air temperature, almost no cracks occur in the rice grains, if the entire polished rice is humidified uniformly. This is because the rate of moisture absorption into the interior of each rice grain is not one-sided partially. In view of this fact, in the rice milling system according to the invention, the moisture is immediately added to the polished rice elevated in temperature under the polishing action due to the rice polishing machine, during a period within which the polished rice is conveyed through the tubular housing while being steered. Moreover, the excess moisture is removed from the polished rice by the air caused to flow by the airflow means while maintaining the temperature of the polished rice. Thus, it is possible for the rice milling system according to the invention to humidify the polished rice for a short period of time without formation of cracks in the polished rice grains.

DETAILED DESCRIPTION

Figure 1:
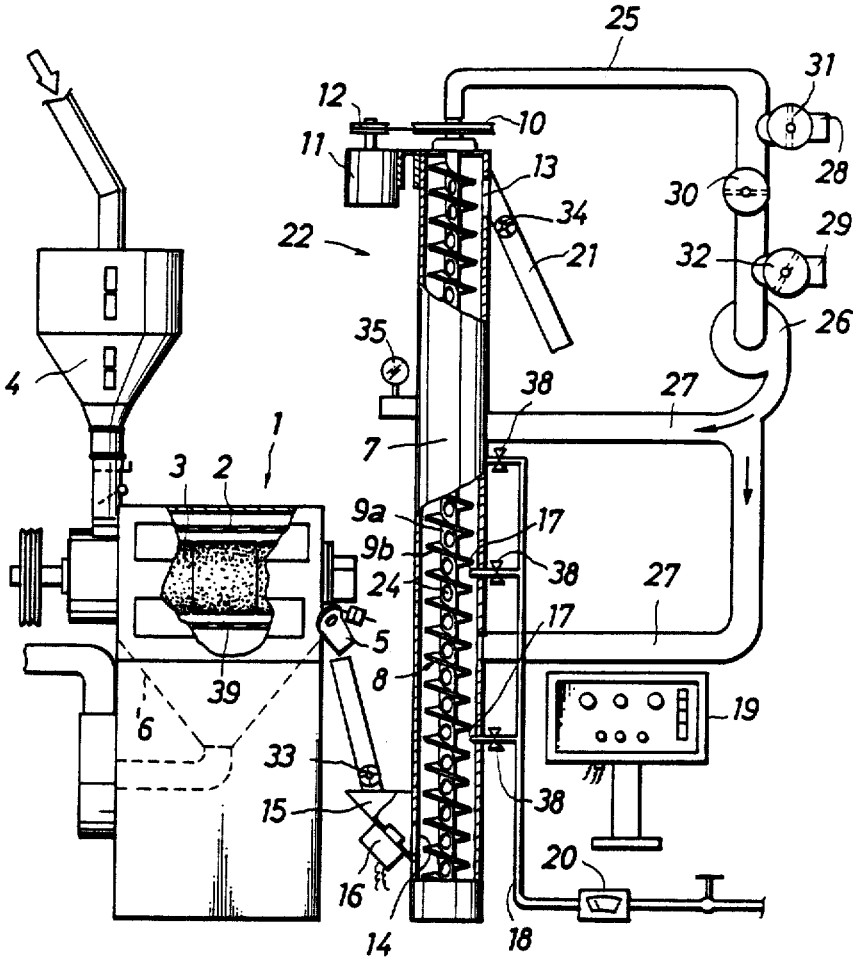
FIG. 1 is a partially broken-away, front elevational view of a rice milling system comprising a rice polishing machine and a polished-rice humidifying apparatus, according to an embodiment of the invention.

Referring first to FIG. 1, there is shown a rice milling system which comprises a rice milling machine 1 and a polished-rice humidifying apparatus 22. The rice polishing machine 1 includes a bran-removing tubular member 2 having a perforated peripheral wall and having an axis extending horizontally. A polishing roll 3 is arranged rotatably within the tubular member 2 in concentric relation thereto. The tubular member 2 and the polishing roll 3 cooperate with each other to define a polishing chamber 39 therebetween. A supply hopper 4 is arranged in communication with one end of the polishing chamber 39, while a discharge port 5 is provided in communication with the other end of the polishing chamber 39. Brown rice is supplied into the polishing chamber 39 through the supply hopper 4. The rotating polishing roll 3 removes bran from the surface of the brown rice to form polished rice. A hopper 6 is arranged within a frame of the rice polishing machine 1 for collecting the bran removed from the brown rice.

The above-described polished-rice humidifying apparatus 22 is arranged downstream of the rice polishing machine 1 with reference to flow of the rice. The humidifying apparatus 22 comprises a screw conveyor 8 having a tubular or cylindrical housing 7 whose axis extends vertically. The housing 7 defines a predetermined transport path for polished rice to be humidified. The screw conveyor 8 has a conveyor shaft **9*a* and a screw 9*b* fixedly mounted on the conveyor shaft 9*a* and extending about the same. An assembly of the screw shaft 9*a* and the screw 9*b* is arranged rotatably within the housing 7 in concentric relation thereto. The conveyor shaft 9*a* has an upper end which projects from the top wall of the housing 7. A pulley 10 is mounted on the projecting end of the conveyor shaft 9*a* for rotation therewith. An electric motor 11 is mounted on the top wall of the housing 7 and has an output shaft. A pulley 12 is mounted on the output shaft of the motor 11 for rotation therewith. A V-belt or the like passes between and around the pulleys 10 and 12. A discharge port 13 is provided in the peripheral wall of the housing 7 at a location adjacent the top wall thereof. On the other hand, a supply port 14 is formed in the peripheral wall of the housing 7 at a location adjacent a lower end thereof. A supply hopper 15 is arranged at the supply port 14 of the housing 7. A temperature sensor 16 is provided on a wall of the supply hopper 15 for detecting temperature of the polished rice fed to the supply hopper 15 from the rice polishing machine 1**.

A moisture-adding device is arranged at the transport path defined by the housing 7, for adding moisture to the polished rice delivered along the transport path. Specifically, the moisture-adding device comprises a plurality of moisture supply nozzles 17 arranged in spaced relation to each other along the transport path. A water line 18 has one end thereof connected to a suitable water source such as, for example, a water tank. The other end of the water line 18 is connected to the moisture supply nozzles 17 through respective flow-rate regulator valves 38. The moisture supply nozzles 17 have their respective forward ends which are arranged within the housing 7, to add the moisture directly to the polished rice conveyed vertically by the screw conveyor 8. Water tap faucets may be provided respectively at the forward ends of the supply nozzles 17 to supply water like shower to the polished rice. Alternatively, water in the form of extremely fine droplets may be supplied to the polished rice. An amount of moisture added is adjusted by the flow-rate regulator valves 38, depending upon flow rate of the polished rice fed to the humidifying apparatus 22 from the rice polishing machine 1 and the moisture content of the polished rice. Further, if the flow rate and the moisture content of the polished rice are determined, the amount of moisture to be added varies depending upon the temperature of the polished rice. That is, if rise in temperature of the polished rice under the polishing action due to the rice polishing machine 1 is small, the amount of moisture added must decrease in order to prevent formation of cracks in the rice grains. Control of the entire amount of water added to the polished rice is effected automatically by a controller incorporated in an operating panel 19. The controller comprises a central processing unit (CPU) and the like. Connected to the controller are a flow-rate control valve 20 provided in the water line 18 and the temperature sensor 16 provided at the supply hopper 15. On the basis of signals from the flow-rate control valve 20 and the temperature sensor 16, the controller executes control of the entire amount of water supplied to the polished rice through the water supply nozzles 17.

A chute pipe 21 is connected to the discharge port 13 of the housing 7. The polished rice after having been humidified is delivered, through the chute pipe 21, directly to an any suitable subsequent processing step. Alternatively, the polished rice after having been humidified by the humidifying apparatus 22 may be delivered again to an apparatus similar to the humidifying apparatus 22. That is, the polished rice may be treated in such a manner that the polished rice passes successively through a plurality of humidifying apparatuses.

An air-flow arrangement for causing air to flow along a part of the transport path and a damper arrangement associated with the air-flow arrangement will be described. The conveyor shaft 9a of the screw conveyor 8 is hollow and has a plurality of ventilation openings 24 formed in the peripheral wall of the conveyor shaft 9a. The hollow portion of the conveyor shaft 9a communicates with the interior of the housing 7 through the ventilation openings 24. The conveyor shaft 9a has open one end to which one end of a discharge pipe 25 is connected. The other end of the discharge pipe 25 is connected to a suction port of a blower 26. Thus, the open one end of the conveyor shaft 9a communicates with the suction port of the blower 26 through the discharge pipe 25. A pair of branch pipes 28 and 29 branch from the discharge pipe 25. A damper 30 is provided in a portion of the discharge pipe 25 extending between the pair of branch pipes 28 and 29. Dampers 31 and 32 are also provided respectively in the pair of branch pipes 28 and 29. The blower 26 has a discharge port which is connected to a pair of air-supply pipes 27 and 27 opening to the interior of the housing 7. The pair of air-supply pipes 27 and 27 are spaced from each other along the axis of the tubular housing 7 and are connected to an intermediate section of the tubular housing 7. Thus, a recirculation path for the air is defined which extends from and to the blower 26 through the air-supply pipes 27 and 27, the interior of the tubular housing 7, the ventilation openings 24 in the peripheral wall of the conveyor shaft 9a, the hollow portion of the conveyor shaft 9a, the open end of the conveyor shaft 9a and the discharge pipe 25. Since the air-supply pipes 27 and 27 are connected to the intermediate section of the tubular housing 7 as described above, the air is caused to flow by the blower 26 along a part of the transport path for the polished rice defined by the tubular housing 7. It is to.be understood that the arrangement comprising the branch pipes 28 and 29 and the dampers 30, 31 and 32 may be provided on the discharge side of the blower 26. A pair of rotary valves 33 and 34 each serving as an air shut-off valve are provided which are associated respectively with the supply port 14 and the discharge port 13 of the housing 7, for permitting the polished rice to flow through the supply port 14 and the discharge port 13, but preventing air from flowing therethrough. A pressure gage 35 is connected to the housing 7 for measuring pressure within the same.

The operation of the rice milling system illustrated in FIG. 1 will be described.

Brown rice grains are charged into the supply hopper 4 of the rice polishing machine 1. The brown rice grains are caused to pass through the polishing chamber 39 defined between the bran-removing perforated tubular member 2 and the polishing roll 3. During passage through the polishing chamber 39, bran layers are removed from the surfaces of the brown rice grains. Thus, the brown rice is polished to form polished rice. The polished rice is discharged through the discharge port 5 and is fed into the supply hopper 15 at the lower section of the housing 7 of the humidifying apparatus 22. The temperature sensor 16 detects temperature of the polished rice within the supply hopper 15 to generate a measurement signal. Normally, the polished rice is elevated in temperature by 15° to 20° C. under the polishing action due to the rice polishing machine 1. The measurement signal from the temperature sensor 16 is converted into a digital signal by an A/D (analog/digital) converter and is inputted to the controller incorporated in the operating panel 19. The polished rice flowing into the tubular housing 7 through the supply port 14 is conveyed vertically upwardly by the screw conveyor 8 along the predetermined transport path. During upward movement of the polished rice, water is supplied to the polished rice through the moisture supply nozzles 17 arranged substantially at the lower half section of the housing 7 in spaced relation to each other, to thereby add moisture to the polished rice.

Specifically, water from the water tank or the like is added directly to the polished rice grains through the water line 18, the flow-rate regulator valves 38 and the moisture supply nozzles 17. An amount of moisture added is set to a predetermined value which increases the moisture content of the polished rice by, for example, 0.5%, under the control of the flow-rate control valve 20 connected to the controller incorporated in the operating panel 19. The amount of moisture added is corrected on the basis of the measurement value from the temperature sensor 16. When the temperature of the polished rice is lower than a predetermined range, an amount of water absorbed by the polished rice decreases in order to prevent cracks from being formed in the polished rice grains. Thus, the polished rice grains having added thereto the moisture are immediately conveyed vertically upwardly by the screw conveyor 8 while being steered during flow of the polished rice. During the upward movement of the polished rice, moisture adheres uniformly to the polished rice grains so that the moisture is absorbed safely by the polished rice grains. Futher, the rice grains are brought into pressure contact with each other, so that a so-called humidifying and polishing action takes place. This humidification and polishing action is repeated several times during flowing and steering of the polished rice so that adjustment in moisture or tempering proceeds to a desirable moisture content. Further, since the flowing and steering continue, the temperature of the polished rice is prevented from being lowered abruptly. Thus, since the rice polishing machine 1 is connected to the humidifying apparatus 22, the temperature of the polished rice is maintained substantially unchanged at a value at which the polished rice is discharged out of the rice polishing machine 1. By this reason, the moisture adhering to the surface of each polished rice grain penetrates into the interior of the rice grain through the entire surface thereof at a high humidification rate, so that no cracks are formed in the rice grain.

On the other hand, by the operation of the blower 26, air is drawn into the suction port of the blower 26 through the branch pipe 29 and a part of the exhaust pipe 25. The drawn air is delivered through the pair of air-supply pipes 27 and 27, and is supplied into the housing 7. The air supplied into the housing 7 is caused to pass through the ventilation openings 24 in the peripheral wall of the conveyor shaft 9*a*, and flows into the hollow portion of the same. At this time, the damper 30 is in a closed position, while the dampers 31 and 32 are in their respective open positions. When it is desired to pressurize the interior of the housing 7, the dampers 30 and 31 are brought to their respective closed positions, while the damper 32 is brought to its open position. Thus, pressure within the housing 7 is increased. As the pressure within the housing 7 reaches a predetermined value, the damper 30 is opened by an optional value so that a recirculation air-flow path is formed which extends from and to the blower 26 through the air supply pipes 27 and 27, the interior of the housing 7, the ventilation openings 24, the hollow portion of the conveyor shaft 9*a*, the open end thereof and the exhaust pipe 25. Thus, the interior of the housing 7 can be maintained constant at the high pressure.

Under such pressurization, the polished rice is conveyed vertically upwardly by the screw conveyor 8 while being steered. During the upward movement, the polished rice grains are brought into contact with each other so that the rice grains are ground. Further, the moisture supplied through the moisture supply nozzles 17 penetrates uniformly into the inner layer of each polished rice grain from the surface thereof flowing while being steered. The polished rice grains humidified and ground are given gloss or luster, and are discharged out of the housing 7 through the discharge port 13. The discharged polished rice is delivered to a subsequent processing line.

In the embodiment illustrated in FIG. 1, the single rice polishing machine 1 is employed. It is needless to say, however, that a plurality of rice polishing machines may be connected in series to each other. Further, the rice polishing machine may be of any type such as friction type, grinding type, horizontal-axis type or vertical-axis type. Moreover, a plurality of agitating or steering projections may be provided on the inner peripheral wall surface of the housing 7 in order to enhance the steering action. Alternatively, a plurality of steering elements may be provided on the screw conveyor 8 in order to promote the steering action.

As described above, the embodiment illustrated in FIG. 1 has the following functional advantages. That is, the arrangement is such that a plurality of moisture supply nozzles 17 are arranged in spaced relation to each other along the transport path. With such arrangement, during transportation of the polished rice by the screw conveyor 8 while steering the polished rice, the moisture is added to the polished rice through first one of the moisture supply nozzles 17 by such an amount as not to cause cracks to be formed in the polished rice. At the time the moisture moves into the interior of each rice grain from the surface thereof, the moisture is again added to the polished rice through second one of the moisture supply nozzles 17 by such an amount as not to cause cracks to be formed in the polished rice. Thus, the polished rice can efficiently be humidified substantially over the entire transport path along which the polished rice is conveyed while being steered. Further, the moisture is added to the polished rice which has been raised in temperature under the polishing action due to the rice polishing machine 1. During transportation of the polished rice through the tubular housing 7 while being steered, the moisture is added uniformly to the surfaces of the rice grains, and the rice grains are ground by friction contact between the rice grains. Moreover, the polished rice is humidified while the temperature of the polished rice is maintained at a predetermined high level. Thus, the moisture can be added to the polished rice grains at high rate with considerably high safety, that is, without formation of cracks in the rice grains, as compared with a case where the polished rice is ordinary or usual in temperature. Furthermore, the moisture is added to the polished rice under the condition that the interior of the housing 7 is pressurized. This makes it possible to add the desirable moisture to the polished rice at a rate about ten to twenty times the ordinary or usual rate that is 0.2% to 0.3% per hour.

Figure 2:
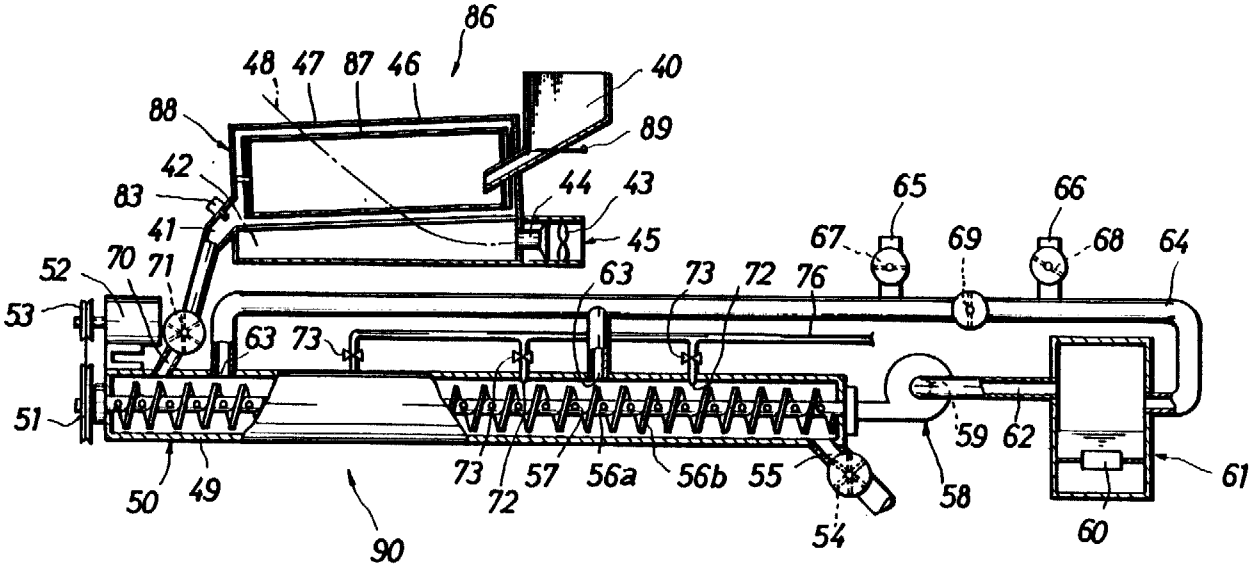
FIG. 2 is a partially broken-away, front elevational view of a polished-rice humidifying apparatus according to another embodiment of the invention in which a tubular housing is arranged horizontally.

Referring next to FIG. 2, there is illustrated a polished-rice humidifying apparatus 90 according to another embodiment of the invention. The humidifying apparatus 90 comprises a heater device 86 which has a tubular rotary member 87 whose peripheral wall is perforated. The tubular rotary member 87 has its axis extending horizontally, and is arranged rotatably within a frame 88. A polished-rice supply hopper 40 provided with a flow-rate adjusting shutter 89 is arranged which extends through one end wall of the tubular rotary member 87. The other end wall of the tubular rotary member 87 is formed with openings through which the polished rice can pass freely. The frame 88 is formed with a discharge port 41 at a location adjacent the other end wall of the tubular rotary member 87. A temperature sensor 83 is provided at the discharge port 41. The frame 88 has its bottom which is provided with an opening extending longitudinally. An air supply duct 42 has one end thereof which is connected to the opening in the bottom of the frame 88. A blower 43 is arranged adjacent the other end of the air supply duct 42. A combustion furnace 44 is arranged between the blower 43 and the one end of the air supply duct 42. Thus, the blower 43 and the combustion furnace 44 cooperate with each other to form a hot-air generating unit 45. The frame 88 has a top wall 47 provided with openings 46 through which the hot air is discharged out of the tubular member 87 and the frame 88. In this manner, a hot-air path 48 is defined which extends from the blower 43 to the exterior of the frame 88 through the air-supply duct 42, the perforation in the peripheral wall of the tubular member 87, the interior thereof, again the perforation in the peripheral wall of the tubular member 87, and the openings 46 in the top wall 47 of the frame 88.

The polished-rice humidifying apparatus 90 has a body which is arranged immediately downstream of the heater device 86. The body of the humidifying apparatus 90 comprises a screw conveyor 50 which includes a tubular or cylindrical housing 49 having its axis extending horizontally. The housing 49 defines a predetermined transport path for polished rice to be humidified. The housing 49 is formed, adjacent one end thereof, with a supply port 70 which is connected to the discharge port 41 of the heater device 86. A rotary valve 71 serving as an air shut-off valve is provided at the supply port 70 for permitting the polished rice to flow through the supply port 70, but preventing air from flowing therethrough. A discharge port 55 is formed in the peripheral wall of the housing 49 at a location adjacent the other end thereof. The discharge port 55 is provided with a rotary valve 54 similar to the rotary valve 71 provided at the supply port 70.

The above-described screw conveyor 50 has a conveyor shaft **56*a* and a screw 56*b* fixedly mounted to the conveyor shaft 56*a* and extending about the same. An assembly of the screw shaft 56*a* and the screw 56*b* is arranged rotatably within the housing 49 in concentric relation thereto. The conveyor shaft 56*a* has one end which projects from one end wall of the housing 49. A pulley 51 is mounted on the projecting end of the conveyor shaft 56*a* for rotation therewith. The pulley 51 is drivingly connected, through a V-belt or the like, to a pulley 53 which is mounted on an output shaft of an electric motor 52 for rotation therewith. The conveyor shaft 56*a* of the screw conveyor 50 is hollow and has a plurality of ventilation openings 57 formed in the peripheral wall of the conveyor shaft 56*a*. The one end of the hollow conveyor shaft 56*a* is closed, while the other end of the conveyor shaft 56*a* is open. The other open end of the conveyor shaft 56*a* is connected to a discharge port of a blower 58 in such a manner that the other end of the conveyor shift 56*a* is slidably rotatable relatively to the discharge port of the blower 58**.

The blower 58 has a suction port 59 which is connected to a discharge pipe 62 os a humidified-air generator 61 provided with an ultrasonic vibrator 60. The humidified-air generator 61 has a suction side which is connected, through a duct 64, to a plurality of air-discharge openings 63 formed in the peripheral wall of the housing 49. The air-discharging openings 63 are arranged in spaced relation to each other along the transport path, and th left-hand air-discharge opening 63 is located adjacent the supply port 70. A pair of branch pipes 65 and 66 are connected to the duct 64, and are provided respectively with dampers 67 and 68. A damper 69 is provided in a portion of the duct 64 which extends between the pair of branch ducts 65 and 66. When the blower 58 is driven to rotate, air is caused to flow along a recirculation air-flow path which extends from and to the blower 58 through the hollow portion of the conveyor shaft **56*a*, the ventilation openings 57, the interior of the tubular housing 49, the discharge openings 63, the duct 64, the humidified-air generator 6u and th discharge duct 62. Since the left-hand discharge opening 63 is located adjacent the supply port 70, the air is caused to flow substantially the entire transport path for the polished rice defined by the tubular housing 49**.

A water line 76 has one end thereof connected to a water source such as a water tank. The other end of the water line 76 branches into three line sections. The line sections of the water line 76 have their respective forward ends which are formed respectively into moisture supply nozzles 72 arranged in spaced relation to each other along the transport path. The line sections of the water line 76 are provided respectively with flow-rate regulator valves 73. The arrangement comprising the water line 76, the mositure supply nozzles 72 and the flow-rate regulator valves 73 is similar to that described with reference to the embodiment illustrated in FIG. 1.

The operation of the polished-rice humidifying apparatus 90 illustrated in FIG. 2 will be described below.

Polished rice grains are charged into the supply hopper 40 of the heater device 86. The polished rice grains charged into the supply hopper 40 flows within the tubular rotary member 87 having the perforated peripheral wall, toward the discharge port 41. During the movement, the polished rice grains are heated by the hot air supplied from the hot-air generator 45. The polished rice grains elevated in temperature are discharge through the discharge port 41. The temperature sensor 83 provided at the discharge port 41 of the heater device 86 detects the temperature of the polished rice discharged. A measurement value of the temperature of the polished rice is sent to a controller, and is compared with an optional setting value. On the basis of the comparion, the controller automatically controls the temperature of the hot air supplied by the hot-air generator 45.

The polished rice grains discharged through the discharge port 41 are supplied into the housing 49 of the body of the polished-rice humidifying apparatus 90 through the rotary valve 71 and the supply port 70. The polished rice grains supplied into the housing 49 are conveyed by the screw conveyor 50 toward the discharged port 55, while being steered. During movement of the polished rice grains toward the discharge port 55, the polished rice grains are humidified by moisture supplied through the plurality of moisture supply nozzles 72. In addition, the polished rice grains are supplementarily subject to the uniform humidifying action by the humidified air supplied from the humidified-air generator 61. Further, because of heat generation due to the steering action of the flowing polished rice, the temperature of the polished rice grains is prevented from being lowered abruptly. Thus, the temperature of the polished rice grains is maintained at a value substantially equal to that at the time the polished rice grains are discharged from the heater device 86. Therefore, the moisture adhering to the surface of each rice grain penetrates into the rice grain at a high rate, so that the rice grain is humidified without formation of cracks therein. The polished rice grains reaching the other end of the housing 49 is discharged through the discharge port 55, and is delivered to a subsequent processing step.

If it is desired to pressurize the interior of the housing 49, the damper 68 provided in the branch pipe 66 is brought to an open position, while the dampers 67 and 69 are brought to their respective closed positions. Under such conditionk, the air is caused to flow by the blower 58. When the pressure within the housing 49 reaches a predetermined value, the damper 69 is opened toa predetermined opening degree to maintain the interior of the housing 49 at a predetermined high pressure.

In the embodiment illustrated in FIG. 2, the air is forcibly delivered into the housing 40 through the hollow portion of the conveyor shaft **56*a* and the ventilation openings 57 in the peripheral wall of the conveyor shaft 56*a*. It is to be understood, however, that the air can be drawn from the interior of the housing 49** through the ventilation openings 57 and the hollow portion of the conveyor shaft 56*a*.

It will be appreciated by one skilled in the art that the embodiment illustrated in FIG. 2 can have functional advantages similar to those of the embodiment illustrated in FIG. 1. A difference between them is only that, in case of the embodiment illustrated in FIG. 1, the temperature of the polished rice to be supplied to the humidifying apparatus 22 is raised under the polishing action due to the rice polishing machine 1, whereas, in the embodiment illustrated in FIG. 2, the polished rice to be supplied to the humidifying apparatus 90 is heated by the heating device 86.

Referring next to FIGS. 3 through 8, there is illustrated a rice milling system according to still another embodiment of the invention. The rice milling system comprises a friction-type rice polishing machine 100 having no humidifying function, rice-grain humidifying apparatus 200, and a rice polishing machine 300 having a humidifying function for grinding polished rice under the action of friction contact between humidified rice grains. A bucket elevator 404 having its axis extending vertically is arranged for supplying raw material or brown rce to the friction-type rice polished machine 100. A bucket elevator 405 is arranged vertically between the friction-type rice polishing machine 10 and the rice humidifying apparatus 200, for supplying polished rice from the friction-type rice polishing machine 100 to the rice humidifying apparatus 200. Further, a bucket elevator 406 is arranged vertically between the rice humidifying apparatus 200 and the humidifying-type rice polishing machine 300, for supplying humidified polished rice to the humidifying-type rice polishing machine 300.

The friction-type rice polishing machine 100 comprises a main shaft 101 having its axis extending horizontally, and a polishing roll 102 mounted on the main shaft 101 for rotation therewith in concentric relation to the main shaft 101. The polishing roll 102 is provided with a plurality of, for example, a pair of diametrically opposed, elongated steering bars extending parallel to the axis of the polishing roll 102. A tubular or cylindrical member 103 having a perforated peripheral wall for removing bran is arranged to surround the polishing roll 102 in concentric relation thereto. The polishing roll 102 and the perforated tubular member 103 cooperate with each other to define a polishing chamber 104 therebetween. A discharge port (not shown) is provided in communication with one end of the polishing chamber 104. Associated with the discharge port in an external pressure unit 105 which is composed of a pressure plate and a plurality of weights for urging the pressure plate toward the discharge port. A discharge chute 106 has one end thereof connected to the discharge port. The other end of the discharge chute 106 communicates with a communication chute 107 connected to a supply port of the bucket elevator 405. On the other hand, th friction-type rice polishing machine 100 has a supply hopper 108 which is connected to a discharge port of the bucket elevator 404 through a chute pipe 109.

Figure 7:
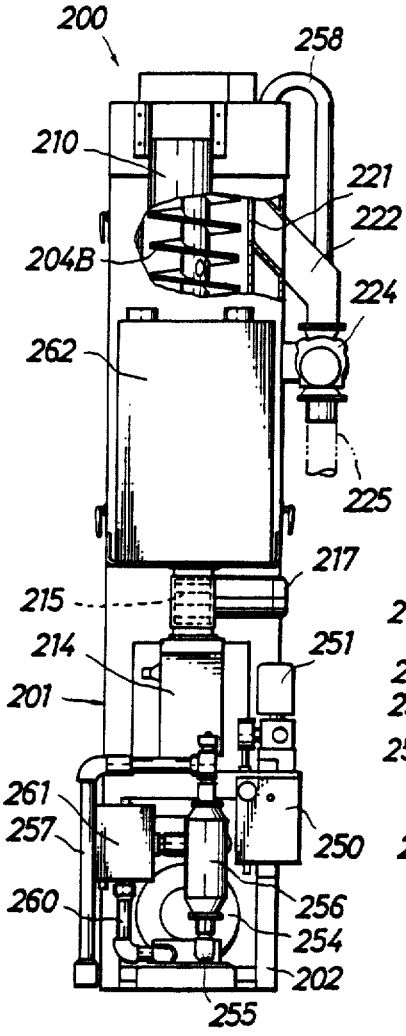
FIG. 7 is a rear elevational view of the rice humidifying apparatus illustrated in FIG. 3.
Figure 8:
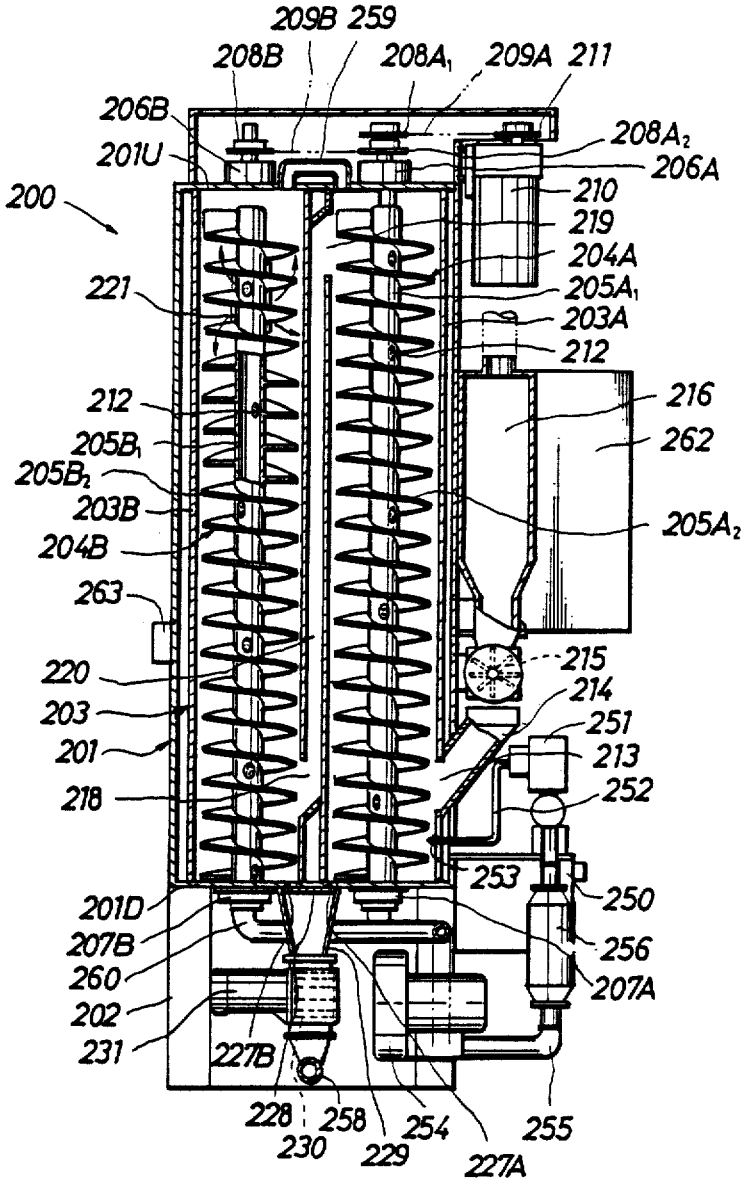
FIG. 8 is a cross-sectional view taken along the line VIII—VIII in FIG. 4.

The rice-grain humidifying apparatus 200 will be described in detail with reference to FIGS. 4 through 8. The humidifying apparatus 200 comprises a frame 201 whose lower portion is formed into a skirt section 202. As shown in FIG. 8, a conveyor arrangement comprises a housing 203 which is arranged within the frame 201 and which is composed of a pair of tubular or cylindrical housing sections 203A and 203B having their respective axes extending vertically. The pair of housing sections 203A and 203B are arranged side by side in parallel relation to each other, to define a predetermined transport path for the polished rice. The conveyor arrangement further comprises a pair of screw conveyors 204A and 204B which rotatably arranged respectively within the housing sections 203A and 203B in concentric relation thereto for conveying the polished rice vertically upwardly. The screw conveyors 204A and 204B have their respective conveyor shafts $205A_1$ and $205B_1$ and screws $205A_2$ and $205B_2$ mounted respectively to the conveyor shafts $205A_1$ and $205B_1$ and extending respectively about the same. The conveyor shafts $205A_1$ and $205B_1$ are rotatably supportd by a top wall 201U and a bottom wall 201D of the frame 201 through of a pair of upper bearings 206A and 206B and a pair of lower bearings 207A and 207B.

The pair of conveyor shafts $205A_1$ and $205B_1$ have their respective upper ends which project upwardly from the top wall 201U of the frame 201. A pair of upper and lower sprockets $208A_1$ and $208A_2$ are mounted on the projecting end of the conveyor shaft $205A_1$ for rotation therewith, while a single sprocket 208B is mounted on the projecting end of the conveyor shaft $205B_1$ for rotation therewith. The lower sprocket $208A_2$ is drivingly connected to the sprocket 208B through a chain 209B. Further, the upper sprocket $208A_1$ is drivingly connected, through a chain 209A, to a sprocket 211 fixedly mounted on an output shaft of an electric motor 210 provided with a reducing gear arrangement. Thus, when the motor 210 is driven, the pair of screw conveyors 204A and 204B are rotated to feed the polished rice vertically upwardly along the transport path. The pair of conveyor shafts $205A_1$ and $205B_1$ are hollow and have their respective upper ends which are closed. Lower ends of the respective conveyor shafts $205A_1$ and $205B_1$ are open. Each of the conveyor shafts $205A_1$ and $205B_1$ has a peripheral wall formed with a plurality of ventilation openings 212 which are convered with wire screens or a net for preventing the polished rice grains from entering the hollow portion of the conveyor shaft.

Figure 3:
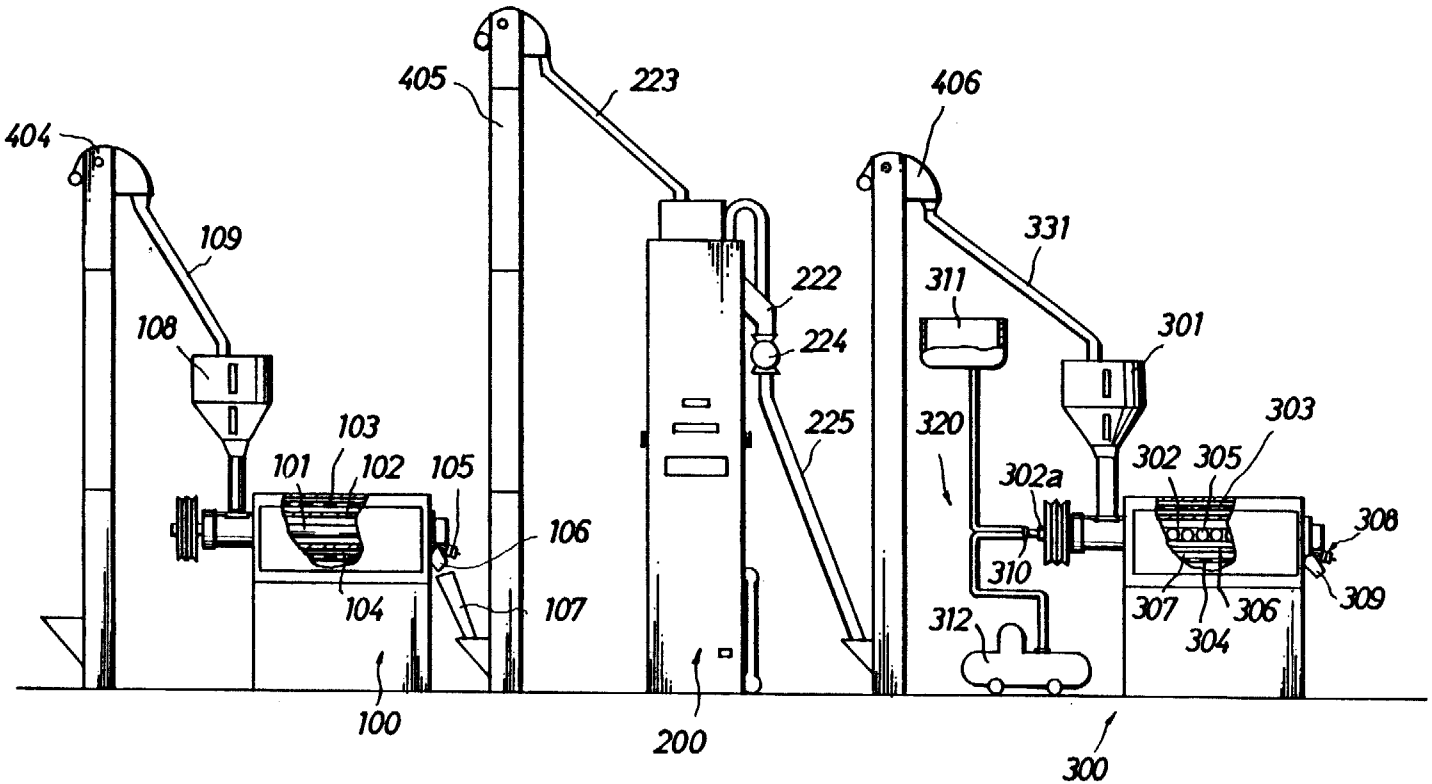
FIG. 3 is a partially broken-away, front elevational view of a rice milling system comprising a plurality of rice polishing machines and a polished-rice humidifying apparatus, according to still another embodiment of the invention.
Figure 4:
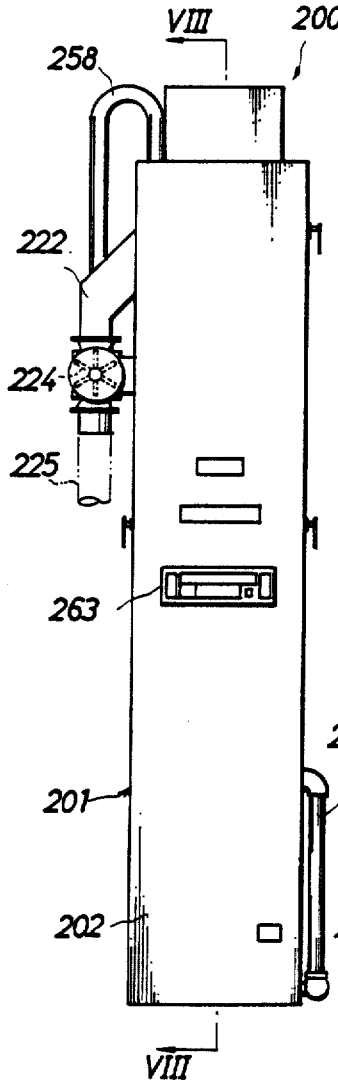
FIG. 4 is a front elevational view of a rice humidifying apparatus illustrated in FIG. 3.
Figure 6:
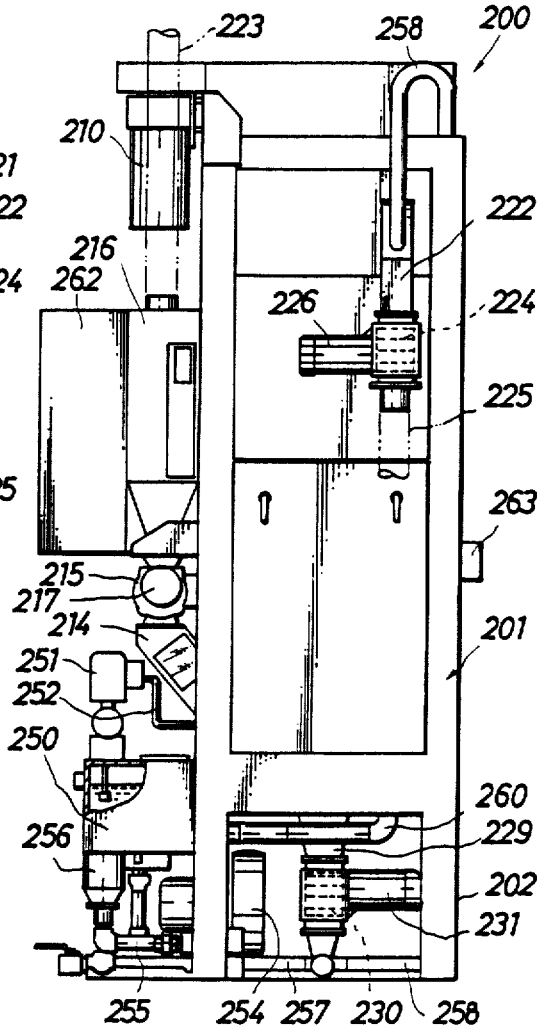
FIG. 6 is a left-hand side elevational view of the rice humidifying apparatus illustrated in FIG. 3.

The housing section 203A as a lower portion which is formed with a supply port 213. A supply chute 214 is connected to the supply port 213 for introducing the polished rice into the housing section 203A through the supply port 213. A supply hopper 216 is arranged above the supply chute 214 and is connected to the same through a supply rotary valve 215 serving as an air shut-off valve. The supply hopper 216 is connected, through a chute pipe 223, to the discharge port of the bucket elevator 405 illustrated in FIG. 3. As shown in FIGS. 6 and 7, an electric motor 217 provided with a reducing gear arrangement is directly connected to the supply rotary valve 215. Referring back to FIG. 8, the housing section 203B is also provided at its lower portion with a supply port 218 which communicates with a discharge port 219 formed in an upper portion of the housing section 203A, through a communication passage 220 defined between the pair of housing sections 203A and 203B. The housing section 203B has a discharge port 221 located adjacent the top wall 201U of the frame 201. The discharge port 221 is connected to a discharge chute 222 arranged on the outside of the frame 201 as shown in FIGS. 4, 6 and 7. The discharge chute 222 is provided therein with a discharge rotary valve 224 serving as an air shut-off valve. The discharge chute 222 has its lower end which is connected, through a chute pipe 225, to the bucket elevator 406 illustrated in FIG. 3. An electric drive motor 226 provided with a reducing gear arrangement is connected to the discharge rotary valve 224 as shown in FIG. 6.

Referring to FIG. 8, the bottom wall 201D of the frame 201 is formed with a pair of residual-rice discharge ports 227A and 227B which communicate respectively with the interiors of the housing sections 203A and 203B. A common shutter 228 is slidably arranged at the discharge pors 227A and 227B. A residual-rice discharge chute 229 has an upper end thereof which is connected to the residual-rice discharge ports 227A and 227B. A residual -rice discharge rotary valve 230 serving as an air shut-off valve is provided in the discharge chute 229, and is connected to an electric motor 231 having a reducing gear arrangement.

As shown in FIGS. 5 through 8, particularly, in FIG. 8, a water tank 250 provided with a pump 251 is arranged on the rear side of the skirt section 202 of the frame 201. The pump 251 has a supply pipe 252 which extends through the peripheral wall of the frame 201 and through the peripheral wall of the housing section 203A. The supply pipe 252 has a forward end which opens to the interior of the housing section 203A at a location below the connection between the housing section 203A and the supply chute 214. A spray nozzle 253 is provided at the forward end of the supply pipe 252, for supplying water in the form of mist to the polished rice flowing into the housing section 203A through the supply chute 214 and the supply port 213.

As shown in FIGS. 4 through 8, particularly, in FIG. 8, a high-pressure blower 254 is arranged within the skirt section 202 of the frame 201. An air duct 255 extending from the blower 254 is connected to a heater 256 for heating air flowing through the air duct 255 An air duct 257 extending from the heater 256 is connected to the lower end of the residual-rice discharge chute 229 provided therein with the residual-rice rotary valve 230, as clearly illustrated particularly in FIG. 6. An air duct 258 connected to the lower end of the residual-rice discharge chute 229 extends vertically upwardly within the frame 201 along the front wall thereof. The air duct 258 extends through the top wall 201U of the frame 201. Subsequently, the air duct 258 extends vertically downwardly and is connected to the top wall of the discharge chute 222, as illustrated in FIGS. 6 and 7. Referring back to FIG. 8, the upper ends of the interiors of the respective housing sections 203A and 203B communicate with each other through a communication duct 259 which is connected to the top wall 201U of the frame 201.

Figure 5:
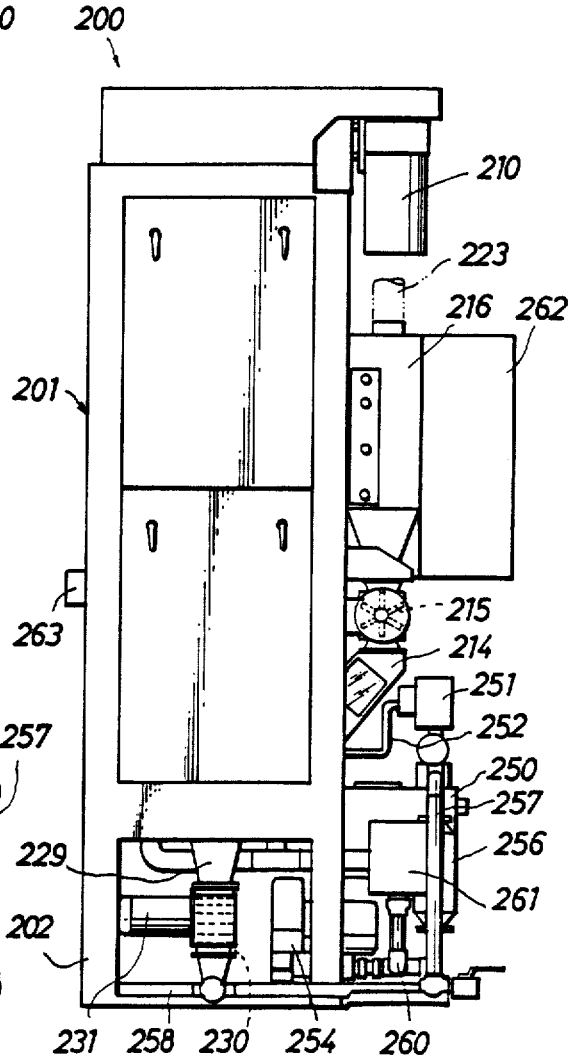
FIG. 5 is a right-hand side elevational view of the rice humidifying apparatus illustrated in FIG. 3.

As clearly shown in FIGS. 5, 7 and 8, the open lower ends of the respective conveyor shafts 205A and 205B are connected to an air-discharge duct 260 which is connected to the suction side of the high-pressure blower 254 through an air filter 261.

Air delivered by the high-pressure blower 254 is returned to the same through a recirculation air-flow path which will be described below. That is, the air delivered by the high-pressure blower 254 flows into the heater 256 through the duct 255, and is heated by the heater 256. The heated air flows through the ducts 257 and 258, and enters the housing section 203B through the discharge chute 222 and the discharge port 221. The heated air entering the housing section 203B flows also into the housing section 203A through the communication duct 259 and through the communication passage 220. The heated air filled in the housing sections 203A and 203B is discharged into the air discharge duct 260 through the ventilation openings 212 in the peripheral walls of the respective conveyor shafts 205A$_1$ and 205B$_1$ and through their respective hollow portions. The air discharge into the air discharge duct 206 passes through the air filter 261 and is returned to the high-pressure blower 254. In this manner, the air flows along the recirculation air-flow path described above. Since the air from the blower 254 enters the housing section 203B through the discharge port 221 through which the humidified polished rice is discharged, the air is caused to flow substantially the entire transport path for the polished rice defined by the housing, sections 203A and 203B.

As shown in FIGS. 4 through 7, a box 262 for an electric power source is arranged in side-by-side relation to the supply hopper 216. Further, an operating box 263 is provided on the front wall of the frame 201, as shown in FIGS. 4 through 6.

The humidifying-type rice polishing machine 300 will next be described with reference to FIG. 3. The humidifying-type rice polishing machine 300 comprises a supply hopper 301 which is connected to the discharge port of the bucket elevator 406 through a chute pipe 331. A main shaft 302 has its axis extending horizontally. The main shaft 302 is hollow and has a plurality of blowing openings 305 formed in a peripheral wall of the main shaft 302. One end **302*a* of the main shaft 302 is open. A polishing roll 303 is mounted on the main shaft 302 for rotation therewith in concentric relation to the main shaft 302. A tubular or cylindrical member 304 having a perforated peripheral wall for removing bran is so arranged as to surround the polishing roll 303 is concentric relation thereto. A pair of diametrically opposed, elongated steering projections are provided on the peripheral wall of the polishing roll 303 and extend along the axis thereof. The polishing roll 303 is formed with a pair of diametrically opposed, elongated blowing slots 306 which extend respectively along the steering projections. The polishing roll 303 and the fubular member 304 cooperate with each other to define a polishing chamber 307 therebetween. A discharge port is provided in communication with one end of the polishing chamber 307. Like the previously described friction-type rice polishing machine 100, an external pressure unit 308 is associated with the discharge port. A discharge chute 309** is connected to the discharge port.

A humidifying device 320 is associated with the rice polishing machine 300. Specifically, the humidifying device 320 comprises a two-phase flow nozzle 310 which is arranged in facing relation to the open one end **302*a* of the main shaft 302. The two-phase flow nozzle 310 is connected to a water tank 311 and to an air compressor 312**.

The operation of the embodiment illustrated in FIGS. 3 through 8 will be described below.

Rice material, that is, brown rice is charged into the supply hopper 108 of the friction-type rice polishing machine 100 by the bucket elevator 404. The brown rice charged into the supply hopper 108 is delivered into the polishing chamber 104 by a screw roll (not shown) mounted on the main shaft 101 for rotation therewith. The brown rice is subject to the steering action by the steering projections on the polishing roll 102. Since the discharge port of the polishing chamber 104 is urged by the external pressure unit 105, the polishing chamber 140 is brought to an adequate high-pressure state. Accordingly, the rice grains are brough to friction contact with each other, whereby surface bran layers of the brown rice grains are removed from the same, and germs of the brown rice grains are also removed from the same. Thus, the brown rice is polished to form polished rice. The bran powder removed from the brown rice grains is discharged through the perforation in the peripheral wall of the tubular member 103.

The rice grains polished during movement through the polishing chamber 104, that is, the polished rice is discharged through the discharged port against the pressure due to the external pressure unit 105. The polished rice discharged flows through the discharge chute 106 and the communication chute 107. The polished rice entering the communication chute 107 is conveyed vertically upwardly by the bucket elevator 405, and is delivered to the subsequent polished-rice humidifying apparatus 200 through the chute pipe 223.

The polished rice is charged into the supply hopper 216 through the chute 223. The polished rice within the supply hopper 216 is supplied into the housing section 203A through the supply chute 214 and the supply port 213 by a constant amount under the action of the supply rotary valve 215 driven to rotate by the motor 226. The polished rice supplied into the housing section 203A is delivered vertically upwardly by the screw conveyor 204A which is driven to rotate by the motor 210 through the sprocket 211, the chain 206A and the sprocket 208A$_1$. The polished rice delivered vertically upwardly falls under the gravity into the housing section 203B through the discharge port 219, the communication passage 220 and the supply port 218. The polished rice is again delivered vertically upwardly by the screw conveyor 204B, and flows into the discharge chute 222 through the discharge port 221. The polished rice flowing into the discharge chute 222 is discharged through the rotary valve 224 and the chute pipe 225. During movement of the polished rice through the housing sections 203A and 203B, the polished rice is supplied with water in the form of mist and is exposed to hot air subsequently to be described.

Water within the water tank 250 is forcibly delivered through the supply pipe 252 by the pump 251, and is jetted through the spray nozzle 253. Water in the form of mist is applied to the polished rice at the bottom of the housing section 203A, that is, is applied immediately to the polished rice charged through the supply port 213. Particles of the water in the form of mist enter also gaps among the polished rice grains, and adhere to the entire surface of each rice grain. Since the polished rice is delivered vertically upwardly by the screw conveyor 204A while being steered, the mist adheres to the entire surface of each rice grains more effectively.

The polished rice having added thereto the water in the form of mist fed through the spray nozzle 253 is delivered vertically upwardly while being steered, by the screw conveyor 204A. During the movement, the rice grains are brought into contact with each other so that the water adhering to each rice grain spreads uniformly over the entire surface of the rice grain. Thus, the water absorption proceeds to the inner layer of each polished rice grain from the entire surface thereof. Further, air delivered by the high-pressure blower 254 is heated by the heater 256 and is supplied into the housing section 203B through the air ducts 257 and 258 and through the discharge chute 222 and the discharge port 221. The hot air flows also into the housing section 203A through the communication duct 259 and the communication passage 220. The hot air flows through the gaps among the rice grains, and is discharged through the ventilation openings 212 formed in the peripheral walls of the respective conveyor shafts 205A$_1$ and 205B$_1$. At this time, the air pressure applied to the polished rice promotes the absorption of water into the rice grains, and evaporates excess moisture from the rice grains. The air discharged through the ventilation openings 212 is retuned to the high-pressure blower 254 through the discharge duct 260, and is gain delivered into the housing sections 203A and 203B. Thus, the air recirculated is brought to hot and humidified air containing a large amount of moisture. The hot and humidified air is applied to the polished rice grains. This also promotes the absorption of water into the polished rice. In addition, since the polished rice is supplied to the polished-rice humidifying apparatus 200 immediately after having been polished by the friction-type rice polishing machine 100, the temperature of the polished rice is relatively high. In addition, the polished rice is subject to the hot air and is further heated. Accordingly, the cellular tissue of each rice grain is expanded and becomes loose, so that the rice grain is brought to a state easy to absorb the moisture. On the other hand, the inner layer of each rice grain is brought to such a state that the moisture moves or diverges from the inner layer toward the surface layer. In such state, even if the moisture is added to each rice grain by an amount of about 1% by weight at a humidifying rate of the order of five (5) times a safe humidifying rate with respect to each rice grain of normal or regular temperature, cracks are not substantially formed in the rice grain, if the entire polished rice is humidified uniformly. This is because the rate of water absorption into the interior of the rice grain is not one-side partially. Thus, the humidification proceeds at a high rate in a safe manner.

Also during movement of the polished rice through the housing section 203B, the polished rice is supplied with the hot and humidified air while being steered so that the absorption of water into the polished rice continues. When the polished rice reaches a location adjacent the upper end of the housing section 203B, the polished rice falls under the gravity into the discharge chute 222 through the discharge port 221. The polished rice falling into the discharge chute 222 is discharged out of the frame 201 by the discharged rotary valve 224 through the chute pipe 225.

When the operation is terminated, the polished rice remaining at the bottoms of the respective housing sections 203A and 203B is discharged out of the frame 201. That is, the shutter 228 is moved to its open position to permit the residual polished rice to fall into the discharge chute 229, thereby feeding the polished rice out of the housing sections 203A and 203B. The polished rice discharged through the rotary valve 230 in the discharge chute 229 is conveyed toward the discharge chute 222, together with the air flowing through the discharge ducts 257 and 258. Only the air flows into the housing section 203B through the discharge port 221, while the residual rice is discharged through the discharge rotary valve 224.

Figure 9:
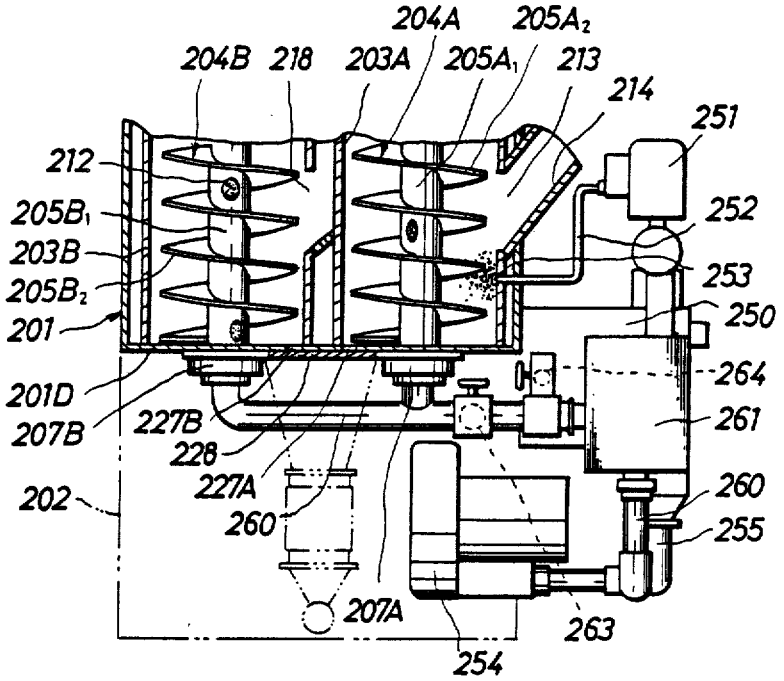
FIG. 9 is a fragmentary enlarged cross-sectional view of a modified form of the rice humidifying apparatus illustrated in FIGS. 3 through 8.

The embodiment illustrated in FIGS. 3 through 8 has been described as having a pair of housing sections 203A and 203B arranged in side-by-side relation. It is to be understood that a single housing section may be arranged, or three or more housing sections may be arranged in side-by-side relation. Alternatively, two or more humidifying apparatuses may be arranged in series. Moreover, the spray nozzle 253 is not limited to one in number, but a plurality of spray nozzles may be arranged in spaced relation to each other along the transport path, similarly to the embodiments illustrated in FIGS. 1 and 2. Furthermore, the humidifying apparatus 200 illustrated in FIGS. 3 through 8 may be modified as shown in FIG. 9 in such a manner that a damper arrangement is provided in the discharged duct 260. Specifically, the damper arrangement comprises an air flow-rate adjusting valve 263 and a fresh-air intake valve 264. In the modified humidifying apparatus illustrated in FIG. 9, the air discharged out of the housing sections 203A and 203B is restricted, and an amount of air supplied into the housing sections 203A and 203B through the air supply duct increases. By doing so, the interiors of the respective housing sections 203A and 203B are maintained at high pressure, making it possible to abosorb the moisture into the polished rice more rapidly.

Referring back to FIG. 3, the polished rice discharged through the discharge rotary valve 224 is then charged into the supply hopper 301 of the humidifying-type rice polishing machine 300 by the bucket elevator 406. The polished rice within the supply hopper 301 is fed into the polishing chamber 307 by a screw roll (not shown) mounted on the main shaft 302 for rotation therewith. Like the friction-type rice polishing machine 100, the polished rice is subject to the steering action due to the steering projections on the polishing roll 303, and the rice grains are brought into friction contact with each other within the polishing chamber 307 while being pressurized by the external pressure unit 308. On the other hand, air containing mist is supplied into the hollow portion of the main shaft 302 through the two-phase flow nozzle 310. The air containing mist is blown into the polishing chamber 307 through the blowing openings 305 and through the blowing slots 306. By the air containing mist, moisture in the form of particles adheres to the surface of each rice grain. Further, the rice grains are brought into contact with each other. Thus, the surfaces of the rice grains are ground in such a manner that bran is removed from the surface of each rice grain. Bran powder containing moisture is solidified and is discharged out of the polishing chamber 307 through the perforation in the peripheral wall of the tubular member 304. In this manner, the polished rice is processed to one which does not contain bran powder and which has a glossy or lustered surface. Furthermore, even if the surface of each polished rice grain discharged out of the humidifying apparatus 200 is not completely dry, but slightly wet, the polished rice can be processed to glossy and dry one by the rice polishing machine 300. That is, during passage through the polishing machine 300, the rice grains are brought into friction contact with each other and is exposed to the humidified air blown through the blowing openings 305 in th peripheral wall of the main shaft 302. Thus, the polished rice is processed to on which is dry and glossy.

The embodiment illustrated in FIGS. 3 through 8 has been described as having the friction-type rice polishing machine 100 which is arranged upstream of the rice-grain humidifying apparatus 200 with reference to flow of the rice. It is to be understood, however, that the friction-type rice polishing machine 100 may be replaced by a grinding-type rice polishing machine.

The embodiment illustrated in FIGS. 3 through 8 and the modification illustrated in FIG. 9 have the following functional advantages. That is, the rice grains polished by the rice polishing machine 100 are supplied to the rice-grain humidifying apparatus 200. The desired humidification of the polished rice is completed during the period within which the polished rice is conveyed vertically upwardly through the housing sections 203A and 203B while being steered. The humidified rice is groun by the rice polishing machine 300, and excess moisture is removed from the rice by the rice polishing machie 300. Thus, it is possible to humidify the polished rice for a very short perior of time and, accordingly, the humdification of the polished rice can be prevented from interfering with a continuous processing line in a rice milling plant. Further, since the moisture is added to the polished rice which has been elevated in temperature by the rice polishing machine 100, cracks are difficult to occur in the rice grains so that the humidification is effected safely and efficiently. Furthermore, the rice grains, which have passed through the rice-grain humidifying apparatus 200 and to which slight moisture adheres, are brought into friction contact with each other by the rice polishing machine 300 so that the rice grains are ground. Thus, the rice grains can be finished into glossy or lustered one.

Moreover, the rice polishing machine 300 is provided with the humidifying device 320. By the humidifying device 320, an adequate amount of moisture is supplied to the rice grains such that the surface of each rice grain is softened slightly. The rice grains are ground under the friction contact between the rice grains by the rice polishing machine 300. Thus, the rice grains can be finished into glossy or lustered ones.

The arrangement of the humidifying apparatus illustrated in FIG. 9 is such that the interiors of the respective housing sections 203A and 203B are pressurized by the damper arrangement. With such arrangement, the polished rice within the housing sections 203A and 203B can be humidified more efficiently.

What is claimed is:

1. An apparatus for humidifying polished rice, comprising:

screw conveyor means comprising a conveyor shaft and a screw fixedly mounted on said conveyor shaft and extending about the same, said conveyor shaft being hollow and having an open end, said conveyor shaft having in a peripheral wall thereof a plurality of ventilation openings through which insides and outsides of said conveyor shaft communicate with each other, said screw conveyor means having around said screw a tubular housing defining a predetermined transport path for the polished rice, for conveying the polished rice, while steering the same, along said transport path;

humidifying means arranged in association with said transport path for adding moisture to the polished rice conveyed along said transport path, by such an amount of moisture as not to form cracks in the polished rice, thereby humidifying the same; and air-flow means arranged in association with said transport path for causing air to flow along said transport path, to remove excess moisture from the polished rice humidified by said humidifying means, said air-flow means including a blower means having a suction port and a discharge port, either one of said ports being connected to said open end of said conveyor shaft.

2. An apparatus according to claim 1, wherein said humidifying means includes a plurality of moisture supply nozzles arranged in spaced relation to each other along said transport path.

3. An apparatus according to claim 1, wherein said air-flow means causes the air to flow along a part of said transport path.

4. An apparatus for humidifying polished rice, comprising:

conveyor means having a tubular housing defining a predetermined transport path for the polished rice, for conveying the polished rice, while steering the same, along said transport path;

humidifying means arranged in association with said transport path for adding mositure to the polished rice conveyed along said transport path, by such an amount of moisture as not to form cracks in the polished rice, thereby humidifying the same; and air-flow means arranged in association with said transport path for causing air to flow along said transport path, to remove excess moisture from the polished rice humidified by said humidifying means;

said apparatus further comprising restrictor means arranged in association with said air-flow means, for restricting the flow of air caused by said air-flow means, to raise pressure within said tubular housing.

5. An apparatus according to claim 4, further comprising supply means connected to said tubular housing at a location adjacent one end of said transport path, the polished rice being supplied onto said transport path through said supply means, and discharge means connected to said tubular housing at a location adjacent the other end of said transport path, the humidified polished rice being discharged out of said tubular housing through said discharge means, wherein said supply means and said discharge means are provided respectively with valves for permitting the polished rice to flow through said supply means and said discharge means, but preventing the air from flowing through said supply means and said discharge means.

6. An apparatus for humidifying polished rice, comprising:

conveyor means having a tubular housing defining a predetermined transport path for the polished rice, for conveying the polished rice, while steering the same, along said transport path;

humidifying means arranged in association with said transport path for adding moisture to the polished rice conveyed along said transport path, by such an amount of moisture as not to form cracks in the polished rice, thereby humidifying the same; and air-flow means arranged in association with said transport path for causing air to flow along said transport path, to remove excess moisture from the polished rice humidified by said humidifying means, wherein said tubular housing has its axis extending vertically, wherein said humidifying means includes a plurality of moisture supply nozzles arranged in spaced relation to each other along said transport path, wherein said air-flow means causes the air to flow along a part of said transport path, wherein said apparatus further comprises restrictor means arranged in association with said air-flow means, for restricting the flow of air caused by said air-flow means, to raise pressure within said tubular housing, supply means connected to said tubular housing at a location adjacent one end of said transport path, the polished rice being supplied onto said transport path through said supply means, and discharge means connected to said tubular housing at a location adjacent the other end of said transport path, the humidified polished rice being discharged out of said tubular housing through said discharge means, and wherein said supply means and said discharge means are provided respectively with valves for permitting the polished rice to flow through said supply means and said discharge means, but preventing the air from flowing through said supply means and said discharge means.

7. An apparatus according to claim 1, wherein said conveyor means includes a conveyor shaft arranged within said tubular housing, and a screw fixedly mounted to said conveyor shaft and extending about the same, wherein said conveyor shaft is hollow and has open one end, said conveyor shaft having a plurality of ventilation openings formed in a peripheral wall of said conveyor shaft, the hollow portion of said conveyor shaft communicating with an interior of said tubular housing through said ventilation openings, and wherein said air-flow means causes the air to flow along a predetermined air-flow path which extends through the interior of said tubular housing, said ventilation openings, the hollow portion of said conveyor shaft and said open one end of the same.

8. An apparatus according to claim 7, wherein said air-flow means includes a blower having a suction port and a discharge port, wherein said suction port is connected to said open one end of said conveyor shaft, and said discharge port is connected to said tubular housing, so that said air-flow path is formed into a recirculation path, wherein said apparatus further comprises supply means connected to said tubular housing at a location adjacent one end of said transport path, the polished rice being supplied onto said transport path through said supply means, discharge means connected to said tubular housing at a location adjacent the other end of said transport path, the humidified polished rice being discharged out of said tubular housing through said discharge means, and restrictor means arranged in said recirculation path for restricting the flow of air caused by said air-flow means, to raise pressure within said tubular housing, and wherein said supply means and said discharge means are provided respectively with valves for permitting the polished rice to flow through said supply means and said discharge means, but preventing the air from flowing through said supply means and said discharge means.

9. An apparatus for humidifying polished rice, comprising:

conveyor means having a tubular housing defining a predetermined transport path for the polished rice, for conveying the polished rice, while steering the same, along said transport path;

humidifying means arranged in association with said transport path for adding moisture to the polished rice conveyed along said transport path, by such an amount of moisture as not to form cracks in the polished rice, thereby humidifying the same; and air-flow means arranged in association with said transport path for causing air to flow along said transport path, to remove excess moisture from the polished rice humidified by said humidifying means;

wherein said tubular housing has its axis extending horizontally, wherein said humidifying means includes a plurality of moisture supply nozzles arranged in spaced relation to each other along said transport path, wherein said air-flow means causes the air to flow along substantially the entire transport path, and wherein said apparatus further comprises supply means connected to said tubular housing at a location adjacent one end of said transport path, the polished rice being supplied onto said transport path through said supply means, discharge means connected to said tubular housing at a location adjacent the other end of said transport path, the humidified polish rice being discharged out of said tubular hosing through said discharge means, and restrictor means arranged in association with said air-flow means, for restricting the flow of air caused by said air-flow means to raise pressure within said tubular housing, and wherein said supply means and said discharge means are provided respectively with valves for permitting the polished rice to flow through said supply means and said discharge means, but preventing the air from flowing through said supply means and said discharge means.

10. An apparatus according to claim 1, further comprising heater means for heating the polished rice to be fed into said tubular housing.

11. An apparatus according to claim 1, further comprising supply means connected to said tubular housing at a location adjacent one end of said transport path, the polished rice being supplied onto said transport path through said supply means, wherein said humidifying means includes a single moisture supply nozzle arranged adjacent the connection between said supplying means and said tubular housing.

12. An apparatus according to claim 1, wherein said tubular housing includes at least two housing sections having their respective axes extending vertically in parallel relation to each other, wherein said conveyor means includes at least two conveyor shafts arranged respectively within said housing sections, and at least two screws fixedly mounted respectively to said conveyor shafts and extending respectively about the same, wherein said apparatus further comprises communication means through which interiors of the respective housing sections communicate with each other, wherein said conveyor shafts are hollow and have their respective open one ends, each of said conveyor shafts having a plurality of ventilation openings formed in a peripheral wall of the conveyor shaft, the hollow portion of the conveyor shaft communicating with an interior of a corresponding one of said housing sections through the ventilation openings, and wherein said air-flow means causes the air to flow along a predetermined air-flow path which extends through the interiors of the respective housing sections, said communication means, the ventilation openings in the peripheral walls of the respective conveyor shafts, the hollow portions of the respective conveyor shafts and said open one ends of the respective conveyor shafts.

13. An apparatus according to claim 12, further comprising supply means connected to said tubular housing at a location adjacent one end of said transport path, the polished rice being supplied onto said transport path through said supply means, and discharge means connected to said tubular housing at a location adjacent the other end of said transport path, the humidified polished rice being discharged out of said tubular housing through said discharge means, wherein said air-flow means includes a blower having a suction port and a discharge port, wherein said suction port is connected to said open one ends of the respective conveyor shafts, and said discharge port is connected to the connection between said tubular housing and said discharge means, so that said air-flow path is formed into a recirculation path, wherein said apparatus further comprises restrictor means arranged in said recirculation path for restricting the flow of air caused by said air-flow means, to raise pressure within said tubular housing, and wherein said supply means and said discharge means are provided respectively with valves for permitting the polished rice to flow through said supply means and said discharge means, but preventing the air from flowing through said supply means and said discharge means.

14. An apparatus according to claim 13, further comprising means for heating the air fed into the interior of said tubular housing.

15. A rice milling system comprising:

a rice polishing machine for polishing brown rice to form polished rice, wherein polishing of the brown rice to the polished rice raises temperature of the polished rice; and an apparatus for humidifying the polished rice from said rice milling machine, said apparatus comprising screw conveyor means including a conveyor shaft and a screw fixedly mounted on said conveyor shaft and extending about the same, said conveyor shaft being hollow and having an open end, said conveyor shaft having in a peripheral wall thereof a plurality of ventilation openings through which insides and outsides of said conveyor shaft communicate with each other, said screw conveyor means having around said screw a tubular housing defining a predetermined transport path for the polished rice, for conveying the polished rice, while steering the same, along said transport path; supply means connected to said rice milling machine and to said tubular housing at a location adjacent one end of said transport path, the polished rice from said rice polishing machines being supplied onto said transport path through said supply means; humidifying means arranged in association with said transport path for adding mositure to the polished rice conveyed along said transport path, by such an amount of moisture as not to form cracks in the polished rice, thereby humidifying the same; air-flow means arranged in association with said transport path for causing air to flow along said transport path, to remove excess moisture from the polished rice humidified by said humidifying means, said air-flow means including a blower means having a suction port and a discharge port, either one of said ports being connected to said open end of said conveyor shaft; and discharge means connected to said tubular housing at a location adjacent the other end of said transport path, the humidified polished rice being discharged out of said tubular housing through said discharge means.

16. A rice milling system according to claim 9, further comprising a second rice polishing machine connected to said discharge means, for further polishing the polished rice discharged out of said tubular housing through said discharge means.

17. A rice milling system according to claim 10 further comprising means arranged in association with said second rice polishing machine for humidifying the polished rice during further polishing of the same by said second rice polishing machine.

18. A rice milling system according to claim 9, wherein said tubular housing has its axis extending vertically, wherein said humidifying means includes a plurality of moisture supply nozzles arranged in spaced relation to each other along said transport path, wherein said air-flow means causes the air to flow along a part of said transport path, wherein said apparatus further comprises supply means connected to said tubular housing at a location adjacent one end of said transport path, the polished rice being supplied onto said transport path through said supply means, discharge means connected to said tubular housing at a location adjacent the other end of said transport path, the humidified polished rice being discharged out of said tubular housing through said discharge means, and restrictor means arranged in association with said air-flow means, for restricting the flow of air caused by said air-flow means, to raise pressure within said tubular housing, and wherein said supply means and said discharge means are provided respectively with valves for permitting the polished rice to flow through said supply means and said discharge means, but preventing the air from flowing through said supply means and said discharge means.

19. A rice milling system according to claim 15, wherein said tubular housing includes at least two housing sections having their respective axes extending vertically in parallel relation to each other, wherein said conveyor means includes at least two conveyor shafts arranged respectively within said housing sections, and at least two screws fixedly mounted respectively to said conveyor shafts and extending respectively about the same, wherein said apparatus further comprises communication means through which interiors of the respective housing sections communicate with each other, wherein said conveyor shafts are hollow and have their respective open one ends, each of said conveyor shafts having a plurality of ventilation openings formed in a peripheral wall of the conveyor shaft, the hollow portion of the conveyor shaft communicating with an interior of a corresponding one of said housing sections through the ventilation openings, and wherein said air-flow means causes the air to flow along a predetermined air-flow path which extends through the interiors of the respective housing sections, said communication means, the ventilation openings in the peripheral walls of the respective conveyor shafts, the hollow portions of the respective conveyor shafts and said open one ends of the respective conveyor shafts.

* * * * *

UNITED STATES PATENT AND TRADEMARK OFFICE
CERTIFICATE OF CORRECTION

PATENT NO. : 4,913,045

DATED : April 3, 1990

INVENTOR(S) : Toshihiko SATAKE

It is certified that error appears in the above-identified patent and that said Letters Patent is hereby corrected as shown below:

Column 9, line 41, change "os" to --of--;
line 48, change "th" to --the--; and
line 60, change "6u" to --61--, and change "th" to --the--.
Column 10, line 19, change "charge" to --charged--;
line 58, change "conditionk" to --condition--;
line 61, change "toa" to --to a--; and
line 64, change "40" to --49--.
Column 11, line 18, after "function," insert --a--;
line 24, change "rce" to --rice--;
line 26, change "10" to --100--;
line 50, change "in" to --is--; and
line 57, change "th" to --the--.
Column 12, line 40, change "convered" to --covered--; and
line 43, change "as" to --has--.
Column 13, line 10, change "pors" to --ports--.
Column 14, line 5, change "discharge" to --discharged--.
Column 15, line 28, change "206A" to --209A--; and Column 16, line 10, change "gain" to --again--.
Column 17, line 9, change "discharged" to --discharge--; and
line 58, change "th" to --the--.

UNITED STATES PATENT AND TRADEMARK OFFICE

CERTIFICATE OF CORRECTION

PATENT NO. : 4,913,045

DATED : April 3, 1990

INVENTOR(S) : Toshihiko SATAKE

It is certified that error appears in the above-identified patent and that said Letters Patent is hereby corrected as shown below:

Column 18, line 8, change "groun" to --ground--.

Signed and Sealed this

Eleventh Day of June, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,913,045

DATED : April 3, 1990

INVENTOR(S) : Toshihiko SATAKE

It is certified that error appears in the above-identified patent and that said Letters Patent is hereby corrected as shown below:

Column 15, line 53, change "grains" to --grain--.

Column 21, line 14, change "polish" to --polished--; and
line 15, change "hosing" to --housing--.

Signed and Sealed this

Eighth Day of September, 1992

*Attest:*

DOUGLAS B. COMER

*Attesting Officer*

*Acting Commissioner of Patents and Trademarks*